US010401085B2

(12) United States Patent
Rocheleau et al.

(10) Patent No.: US 10,401,085 B2
(45) Date of Patent: Sep. 3, 2019

(54) AIR BAR ARRANGEMENT FOR DRYING TISSUE ON A BELT

(75) Inventors: Michael Rocheleau, DePere, WI (US); Thomas Manning, DePere, WI (US)

(73) Assignee: Durr MEGTEC, LLC, DePere, WI (US)

( * ) Notice: Subject to any disclaimer, the term of this patent is extended or adjusted under 35 U.S.C. 154(b) by 717 days.

(21) Appl. No.: 13/225,755

(22) Filed: Sep. 6, 2011

(65) Prior Publication Data

US 2012/0060388 A1 Mar. 15, 2012

Related U.S. Application Data

(60) Provisional application No. 61/381,560, filed on Sep. 10, 2010.

(51) Int. Cl.
*F26B 13/10* (2006.01)
*F26B 21/04* (2006.01)
(Continued)

(52) U.S. Cl.
CPC ..... *F26B 13/101* (2013.01); *F26B 13/103* (2013.01); *F26B 21/04* (2013.01); *F26B 21/10* (2013.01); *F26B 23/022* (2013.01)

(58) Field of Classification Search
CPC .... F26B 13/101; F26B 13/103; F26B 23/022; F26B 21/10; F26B 21/04; F26B 13/104;
(Continued)

(56) References Cited

U.S. PATENT DOCUMENTS 28,459 A * 5/1860 Kurie ..... C04B 30/02 252/62
2,671,279 A * 3/1954 Blanchard ..... F26B 13/103 34/240
(Continued)

FOREIGN PATENT DOCUMENTS

| | | | |
|---|---|---|---|
| CA | 2474489 | A1 | 7/2003 |
| CA | 2526035 | A1 | 12/2004 |
| WO | 2010141587 | A1 | 12/2010 |

OTHER PUBLICATIONS

International Search Report/Written Opinion dated Jan. 31, 2012 in corresponding PCT Application No. PCT/US2011/050491.
(Continued)

*Primary Examiner* — Kenneth Rinehart
*Assistant Examiner* — Bao D Nguyen
(74) *Attorney, Agent, or Firm* — Nields, Lemack & Frame, LLC

(57) ABSTRACT

Apparatus and methods particularly suited for drying tissue grade paper. In certain embodiments, a wet web, such as a web exiting a tissue manufacturing machine, is transferred to an air floatation dryer with specially arranged air bars and impingement nozzles described herein where the wet web is dried while still at least partly supported by an air-permeable belt. In certain embodiments, the specially arranged air floatation dryer comprises one or more air floatation dryer units through which the wet web is conveyed by way of a supporting endless loop or belt of air-permeable construction. The air bars and opposing impingement nozzles are so arranged as to force the web into contact with the belt and then subsequently lift the web from the belt surface in a repetitive and alternating fashion as the web and belt travel through the dryer.

10 Claims, 5 Drawing Sheets

(51) Int. Cl.
*F26B 21/10* (2006.01)
*F26B 23/02* (2006.01)

(58) Field of Classification Search
CPC . B65H 20/14; D21F 5/18; D21F 11/00; D21F 2/00; D21F 5/185; D21F 5/187; D21F 5/188; D21F 3/0227
USPC ..... 34/659
See application file for complete search history.

(56) References Cited

U.S. PATENT DOCUMENTS 3,231,165 A 1/1966 Wallin et al.
3,618,226 A * 11/1971 Goldenberg et al. ..... 34/640
3,711,960 A 1/1973 Overly et al.
3,776,440 A 12/1973 Frost et al.
RE28,459 E * 7/1975 Cole ..... D21F 5/18 162/115
4,785,986 A 11/1988 Daane et al.
5,395,029 A * 3/1995 Kurie ..... F26B 13/104 226/7
5,647,144 A * 7/1997 Bria ..... F26B 13/104 34/414
5,749,164 A * 5/1998 Bowden ..... F26B 13/104 34/641
2003/0145481 A1* 8/2003 Zagar ..... F26B 13/104 34/83
2009/0321032 A1 12/2009 Graf

OTHER PUBLICATIONS

Canadian communication dated Mar. 17, 2015 in corresponding Canadian patent application No. 2,807,391.
International Preliminary Report on Patentability dated Mar. 21, 2013 in corresponding PCT application No. PCT/US2011/050491.
Canadian communication dated Sep. 29, 2015 in corresponding Canadian patent application No. 2,807,391.

* cited by examiner

AIR BAR ARRANGEMENT FOR DRYING TISSUE ON A BELT

This application claims priority of U.S. Provisional Application No. 61/381,560 filed Sep. 10, 2010, the disclosure of which is incorporated herein by reference.

FIELD

The embodiments disclosed herein relate to devices for contactlessly guiding and drying traveling webs, and more particularly, an improved web handling arrangement particularly suited for drying tissue with combined air flotation and mechanical support on a belt.

BACKGROUND

In paper and tissue web drying operations, it is often desirable to remove water by evaporation following initial dewatering steps which remove water from the paper fiber by mechanical means. Typical mechanical dewatering is carried out in a Fourdrinier machine or similar device, wherein one or more suction boxes are arranged to pull an air vacuum through a traveling wire or fabric belt while the wet paper fiber slurry is carried on the opposite surface of said fabric belt in relation to the suction boxes. This mechanical dewatering step is typically not capable of removing sufficient water to meet the requirements of the final moisture content of the paper or tissue product. Typically, additional moisture is required to be removed by evaporation in one or more drying steps.

One conventional method for drying a continuous web of uncoated or unsized paper, including tissue, uses cast iron dryer cans or larger structures called "Flying Dutchman" or "Yankee Dryers," both of which are also cast iron drums. All of these conventional cast iron drums are rotating devices wherein the web to be dried is brought into contact with a heated surface. Heat is thus conducted to the web directly but the solid surface of the drum blocks mass transfer by convection on the side in contact with the drum. Mass transfer occurs only on the side opposite the contacting surface. This effectively limits the drying rate that could otherwise be achieved if one side were not blocked from mass transfer by the drum surface.

It is known to those skilled in the art that a continuous web may be dried simultaneously from both sides by means of hot air impingement nozzles positioned on both sides of a web. Heat and mass transfer may be brought to both sides of the web by a type of impingement dryer which supports the web using flotation nozzles or "air bars" as they are referred to by those skilled in the art.

One conventional arrangement for contactlessly supporting a web during drying includes horizontal upper and lower sets of air bars between which the web travels. Hot air issuing from the air bars both dries and supports the web as it travels through the dryer. The air bar array is typically inside a dryer housing which can be maintained at a slightly sub-atmospheric pressure by an exhaust blower that draws off the moisture or other volatiles emanating from the web as a result of the drying of the water, coating or ink thereon, for example.

It would be desirable to utilize air flotation to convey and dry wet tissue webs at the high speeds associated with tissue manufacture, such as tissue grade paper including bath or facial tissue and towel products. However, air bar arrangements in conventional flotation dryers are designed to float a continuous web under tension without support from a belt.

In most cases tissue or light paper is not strong enough to sustain the web tension necessary for conventional flotation, therefore it is desirable to retain the belt for support. However, conventional flotation dryers exhibit insufficient web handling characteristics when a web such as tissue or light paper is carried on a fabric support belt. Experiments carried out in a pilot dryer with belt support showed excessive movement of the tissue on the belt leading to web billowing and lateral bunching, or narrowing (roping) leading to web breaks when conventional air bars were run at air velocities needed to dry at the evaporation rates necessary for tissue or paper production rates to be commercially successful. Air velocities above 4000 feet per minute were problematic to web handling, yet air velocities in excess of 10,000 feet per minute are most desired for sufficiently high heat and mass transfer to support drying rates needed for economical production of tissue and paper.

SUMMARY

The problems of the prior art have been overcome by the embodiments disclosed herein, which provides apparatus and methods particularly suited for drying tissue grade paper. In certain embodiments, a wet web, such as a web exiting a tissue manufacturing machine, is transferred to an air floatation dryer with specially arranged air bars and impingement nozzles described herein where the wet web is dried while still at least partly supported by an air-permeable belt. In certain embodiments, the specially arranged air floatation dryer comprises one or more air floatation dryer units through which the wet web is conveyed by way of a supporting endless loop or belt of air-permeable construction.

By using an air floatation dryer section having an array of air bars that force the web to the surface of the supporting belt and opposing impingement nozzles that subsequently lift the web from the belt by forcing at least some air through the porous belt, stability of the tissue web on the belt is maintained while delivering air velocities capable of drying at high capacity in a tissue making machine. The air bars and opposing impingement nozzles are so arranged as to force the web into contact with the belt and then subsequently lift the web from the belt surface in a repetitive and alternating fashion as the web and belt travel through the dryer. The air floatation dryer also provides a more efficient drying due to greater fiber surface availability to hot dry air at high velocities and more efficient contact of dry air molecules to carry away moisture. In addition, benefits include bulk reduction in energy consumption (per ton produced), as well as capital costs and reduction in building height required compared to through air drying. By providing an endless loop to convey and support the wet web through an air floatation dryer, sheet breaks become less of an issue which allows greater machine operating efficiency. The machine can be self-threading.

In certain embodiments, disclosed is a layout of air flotation bars within a housing capable of drying a wet web with high velocity hot air without damaging or disturbing the flatness and wet adhesion of the web to the carrier belt. Each spaced apart air bars is elongate and arranged such that its longitudinal axis is transverse to the longitudinal axis of the dryer. In certain embodiments, disclosed are differential controls that allow for web stability and uniform drying when compensating for the carrier belt under the web, and that minimize or eliminate damage to the belt due to excessive movement.

DETAILED DESCRIPTION

The paper making method aspect of this technology is not particularly limited; the initial wet web can be formed using conventional forming methods that are well known in the papermaking industry. For example, a Fourdrinier machine, twin wire machine, crescent former, C-wrap machine etc, can be used to form a wet web. In accordance with certain embodiments, the wet web is initially dewatered then transferred to an air floatation dryer and further dried. The air floatation dryer may comprise one or more air floatation units. The wet web is supported by an endless loop, such as a plastic carrier belt, as it is transferred through the air floatation dryer. One suitable fabric is AstenJohnson fabric design MacroShape AJ-165 at 168.0-lbs/1000 sqft.

Suitable papermaking fibers include cellulosic and synthetic fibers that are useful in making tissue paper. The fibers may be virgin or recycled.

The wet web, such as a wet tissue web, is transferred to an air floatation dryer device. Any conventional manner of transferring a wet web from the wet end of a papermaking machine to the dry end may be used, including a transfer fabric and a suction transfer box.

The wet web entering the air flotation dryer is transported through the air floatation dryer device while supported by an endless loop. In stating that the wet tissue web is supported, it is understood that due to air movement within the dryer, the wet web may not be in contact with the endless loop at all times during its transit through the air floatation dryer. The temperature of the air in the air floatation dryer device may range from about 212-1,000° F. or higher. The endless loop or belt may be a fabric such as a woven fabric made from polyester or other polymers, plastic, and materials that are compounded for greater heat resistance. The hot air used in the air floatation dryer may be heated by conventional energy sources such as steam, natural gas, oil, propane, geothermal, solar etc. Thermal efficiency of the air floatation dryer device can be enhanced by providing a heat recovery system so that the high humidity heat values of the exhaust air can be used, e.g., to heat the fresh makeup air.

This technology may comprise one or more air flotation units, including one, two or three such units. It is also understood that other conventional dryer units, such as steel drums or a Yankee dryer, may be used after the web emerges from the air floatation drying operation as desired.

In accordance with certain embodiments, the arrangement of air bars in the air floatation dryer allows for the high velocity drying of the web without damaging or disturbing the flatness and wet adhesion of the web to the carrier belt. The high velocity air allows for faster drying of the saturated web than conventional steel drum technology, and thus shorter machine lengths and straight runs are possible.

Figure 1:
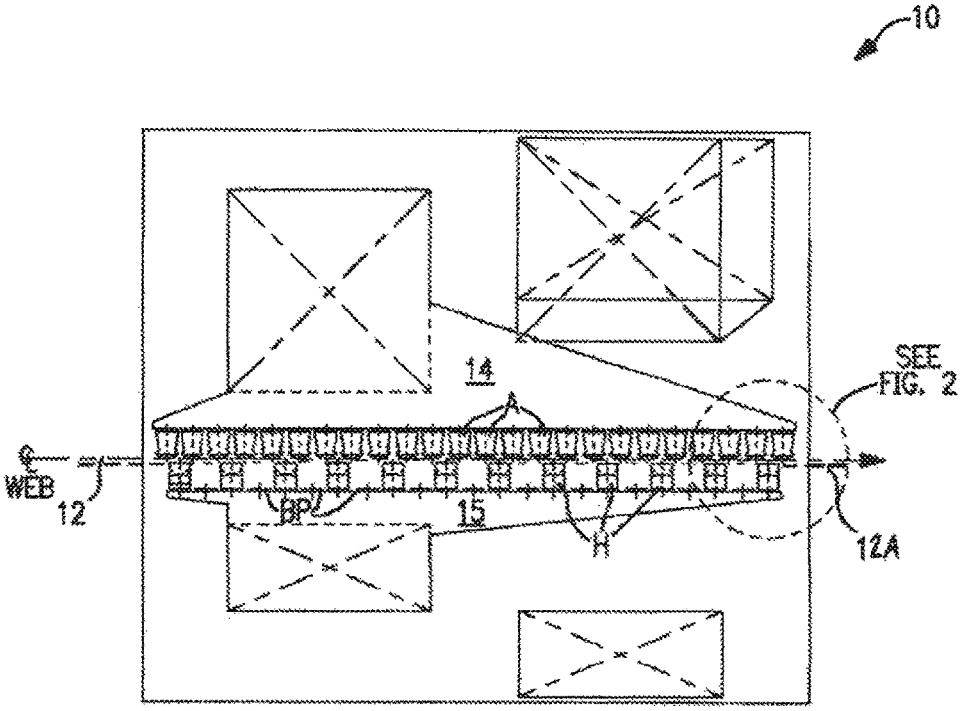
FIG. 1 is a schematic diagram of an air bar arrangement in accordance with certain embodiments.

Turning now to FIG. 1, there is shown a dryer unit 10 having a web inlet slot and a web outlet slot spaced from the web inlet slot. Web 12 is guided into the dryer unit 10 while carried on belt 12*a* through the inlet slot. In the embodiment shown, the dryer unit 10 includes a housing for a plurality of upper air bars and lower impingement nozzles. The upper air bars are mounted in air-receiving communication to an upper air supply header 14 and receive heated air therefrom. The lower air bars (impingement nozzles) are mounted in air-receiving communication to a lower air supply header 15 and received heated air therefrom.

Although the embodiments disclosed herein are not limited to any particular flotation nozzle design, it is preferred that flotation nozzles which exhibit the Coanda effect such as the HI-FLOAT® air bar commercially available from Megtec Systems, Inc. be used in the air bar array above the web, in view of their high heat transfer and excellent flotation characteristics. In such Coanda air bars, air flows flowing from each of the air nozzles A1, A2 converge towards the center of the bar. Standard 1X HI-FLOAT® air bars are suitable and are characterized by a spacing between slots (two) A1 and A2 of 2.5 inches; a slot width of 0.070 to 0.075 inches, usually 0.0725 inches; an installed pitch of 10 inches; and a web-to-air bar clearance of from about ⅛ to about ½ inch. In certain embodiments, 1X HI-FLOAT® air bars with wider slot widths, such as slot widths of 0.1 inches are preferred, installed on a five inch pitch to obtain more drying power.

Air bar size can be larger or smaller. For example, air bars ½, 1.5, 2 and 4 times the standard size can be used. Air bars two times the standard size are characterized by a slot distance of 5 inches and slot widths of 0.140 to 0.145 inches (available commercially as "2× air bars" from Megtec Systems, Inc.). In general, the greater distance between the slots results in a larger air pressure pad between the air bar and the web, which allows for increasing the air bar spacing.

The opposing impingement nozzles may be of the same flotation air bar type described for the air bars with limited air velocities to avoid web handling problems. In certain preferred embodiments the opposing impingement nozzle arrays also include means for creating direct air impingement on the web, such as a direct impingement nozzle having a plurality of apertures, such as a hole-array bar or slot bar. Such direct impingement nozzles provide a higher heat transfer coefficient for a given air volume and nozzle velocity than a flotation nozzle. As between the hole-array bar and the slot bar, the former provides a higher heat transfer coefficient for a given air volume at equal nozzle velocities. Although maximum heat transfer is obviously a goal of any dryer system, other considerations such as air volume, nozzle velocity, air horsepower, proper web flotation, dryer size, web line speed, etc., influence the extent to which optimum heat transfer can be achieved, and thus the appropriate design of the direct impingement nozzle. The direct impingement nozzles are preferably positioned below the web (the belt 12*a* is between the impingement nozzle and the web.

Figure 2:
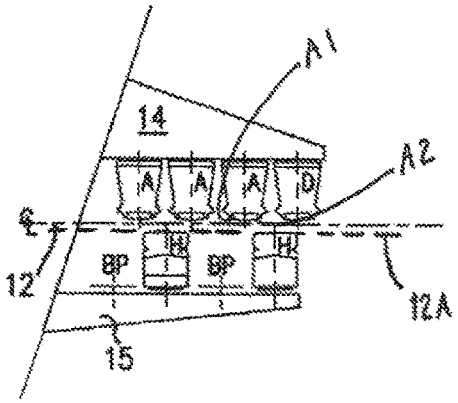
FIG. 2 is an enlarged view of a portion of the air bar arrangement of FIG. 1 in accordance with certain embodiments.

FIGS. 1 and 2 show schematically a preferred flotation nozzle/direct impingement nozzle arrangement. Web 12 is shown floatingly supported between upper and lower flotation nozzle/direct impingement nozzle arrays. The upper air bar array includes a plurality of spaced elongate flotation air bars A, preferably HI-FLOAT® Coanda air bars. The distance between air bar A centers, or "air bar pitch", should be between about 5 and about 10 inches, preferably 5 inches for the 1× air bars. This distance would scale proportionately for other air bar sizes such as a 2× air bar. In certain embodiments, the end or final air bar in the array is a dampered air bar D for control of the air velocity issuing therefrom.

Figure 6A:
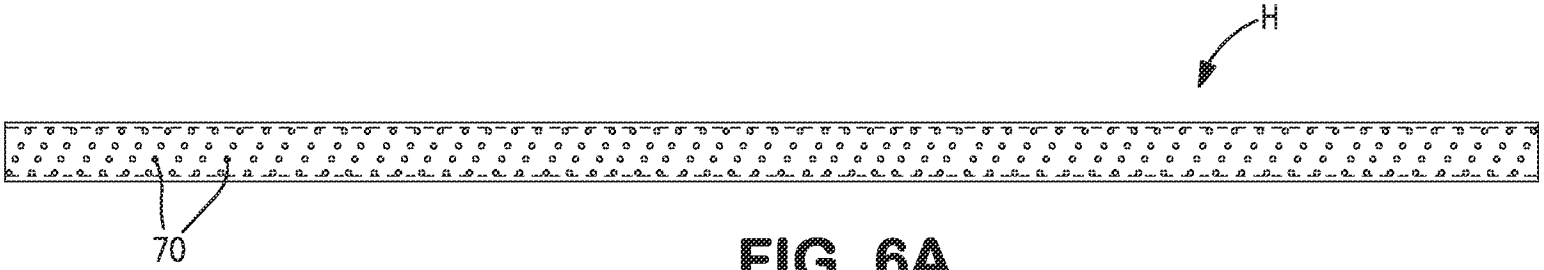
FIGS. 6A and 6B are top and bottom view of an impingement nozzle in accordance with certain embodiments.

A preferred embodiment of a direct impingement nozzle hole bars H is shown in FIGS. 1, 2 and 6A and B. Elongate hole bar H is installed in air-receiving communication with a header 15. Header 15 feeds air into each hole bar H, which then emits the air via a plurality of apertures, such as spaced circular holes in the top surface of the hole bar H.

Figure 3:
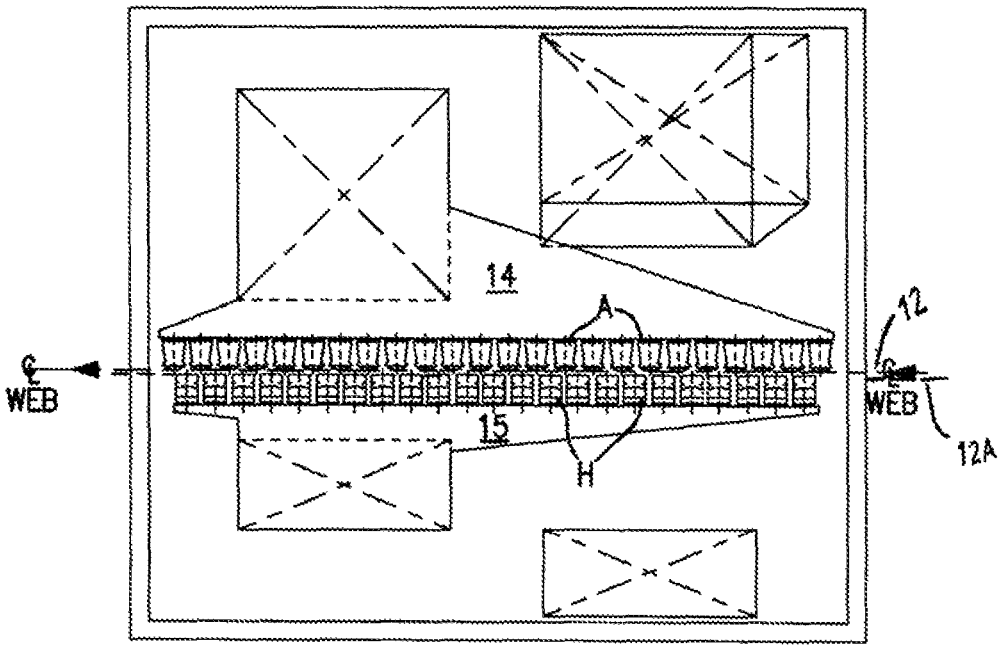
FIG. 3 is another schematic diagram of an air bar arrangement in accordance with certain embodiments.
Figure 4:
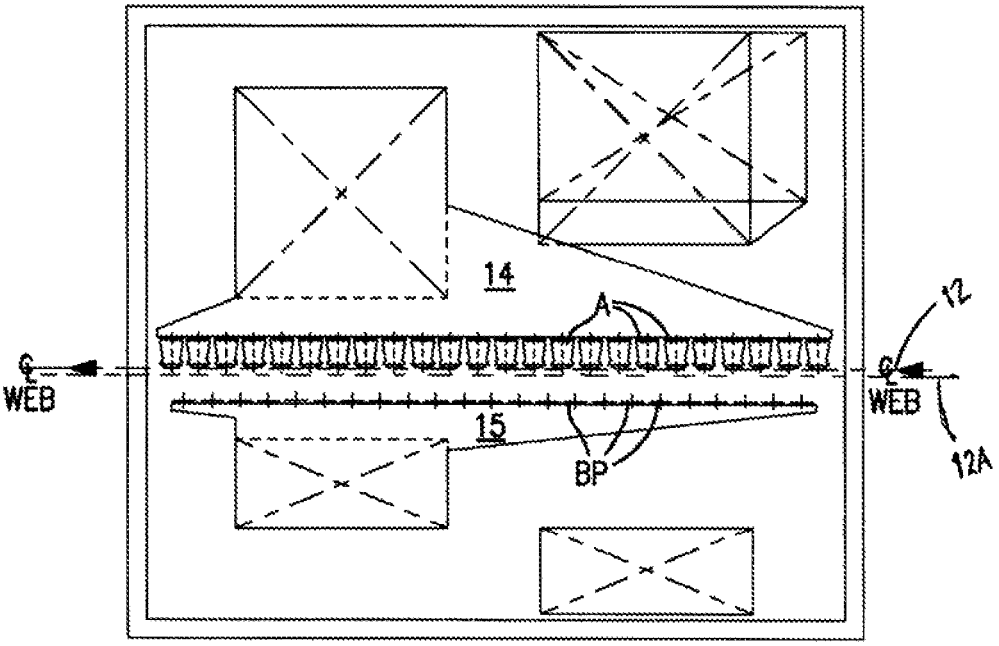
FIG. 4 is another schematic diagram of an air bar arrangement in accordance with certain embodiments.

In certain embodiments, the hole bars H are spaced from about 5 to about 10 inches apart (e.g., the distance between the centers of any two hole bars H is about 5-10 inches), with 10 inches being preferred. In certain embodiments, each hole bar H is positioned opposite two air bars and is centered between the two air bars. In certain embodiments, the space between hole bars is sealed with bank off plates BP. These allow flexibility in installing additional hole bars H in their place, if desired. For example, if each blank off plate BP is replaced by a hole bar H, the resulting array will be a plurality of hole bars H positioned at 5 inch centers, as shown in FIG. 3. Similarly, the holes bars H shown could be selectively removed and replaced by blank off plates BP, thereby reducing the number of hole bars H or eliminating all bars completely from the bottom array, as shown in FIG. 4. In certain embodiments, the hole bars H are 4 inches wide with a plurality of circular holes that are 5/16 inches in diameter.

Figure 6B:
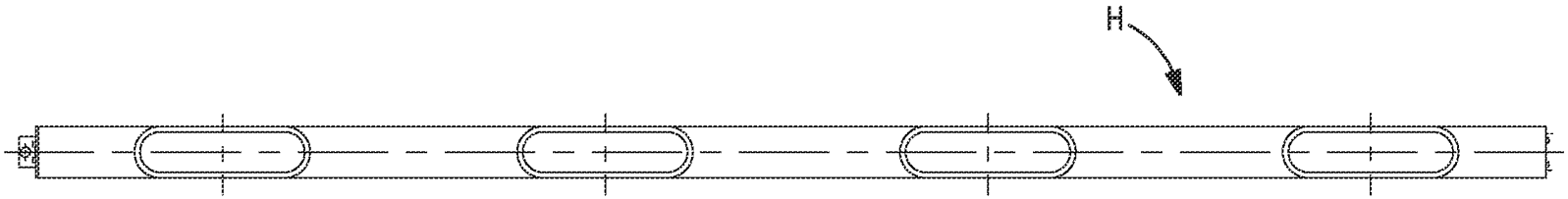

The particular pattern and configuration of apertures in the top surface of each hole bar H is not critical, as long as relatively uniform coverage of the web is provided, and the impingement of air is not directly over the center of the pressure pad generated by an opposing air bar. An open area of from about 1.5 to about 4.3%, preferably about 3%, is suitable. It should be understood by those skilled in the art that the number of rows of holes and the number of holes per row can vary, depending in part upon the size of the hole bar for the application. Where the apertures of the hole bars are of a different configuration, such as diamonds, square or rectangular slots, preferably they have an equivalent diameter of from about 0.2 to 0.5 inches. In the embodiment shown in FIG. 6, there are four rows of holes 70, in the longitudinal direction, each hole having a diameter of 0.313 inches. The rows are spaced 0.9 inches apart.

Figure 5:
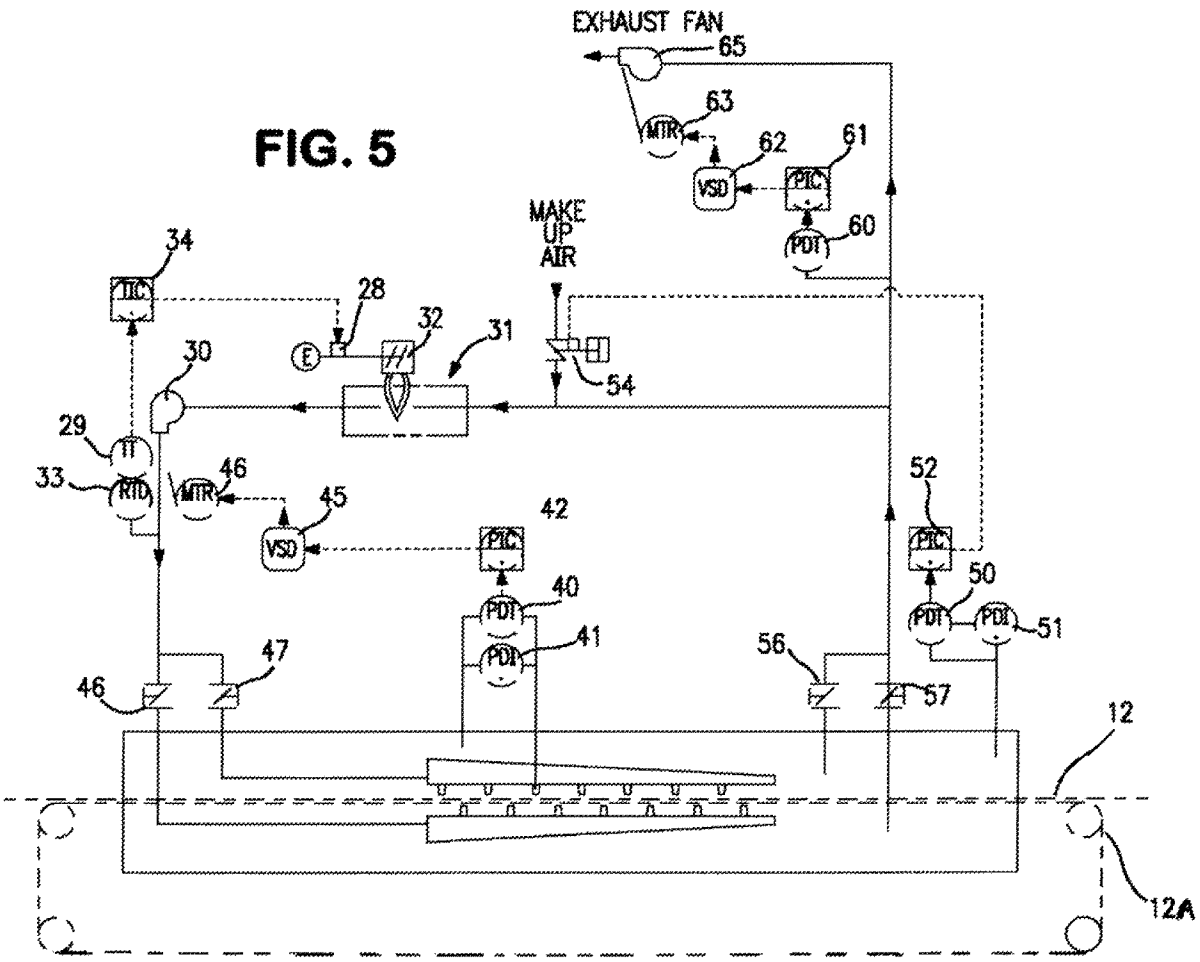
FIG. 5 is a schematic diagram of a dryer in accordance with certain embodiments.

Control of the drying air pressure and temperature is carried out by circulating drying air with a fan 30 (FIG. 5) which supplies heated air to the air bars and impingement nozzles (supply air) having been heated by passing through a heating plenum 31 which includes a suitable heat source 32, such as a burner or other means mentioned previously. Temperature of the air is measured by a sensor 33 such as a thermocouple and the signal is fed, with a temperature transmitter 29 to a closed-loop feedback controller 34 which modulates the heat energy introduced in the heating plenum, such as a servo-positioner 28 linked to the gas and combustion air valves of the burner. Supply air temperatures typically range from 210 to 1000° F., most preferably in the range of 300 to 600° F.

Air pressure and hence velocity is balanced between the air bars, which force the web into contact with the belt, and the opposing impingement nozzles, which tend to lift the web from contact with the belt, by means of dampers 46, 47 and/or fan speed control. Air pressure delivered to the air bars is typically higher than that delivered to the opposing impingement nozzles in order to deliver the required air velocity for the desired web stability as well as drying rate. Air velocity of the air jets issuing from the air bars is typically in the range of 10,000 to 20,000 feet per minute for typical web materials such as toweling and tissue, and lower velocities in the range of 4000-10000 fpm are used for sensitive web materials having lower mechanical strength. The velocity of the air jets issuing from the opposing impingement nozzles is typically in the range of 2000 to 8000 feet per minute. Furthermore, the velocity of air from the impingement nozzles is to be set such that it is in the range of 20 to 50% of the velocity of air issuing from the air bars. These velocities may be measured with a manometer and translated into velocity by air flow calculations well-known to those skilled in the art. Velocity may be adjusted and set to the desired target manually by means of mechanical dampers, or said dampers may be actuated by a servo-positioner or other suitable actuator. Alternatively, pressure sensors may be used to transmit a scaled value representing the pressure delivered to the air bars and impingement nozzles to closed-loop controllers which automatically adjust the dampers to achieve the desired pressure representing the target air velocities.

In a preferred embodiment, the air pressure to the air bars is modulated by selection of speed set point of a variable frequency drive 45 which rotates the supply fan 30 wheel in order to supply the desired air pressure to the air bars through ductwork connected to the air distribution header (plenum) which distributes the air to the air bars. A branch duct from the fan 30 outlet is also connected to an air distribution header which delivers air to the impingement nozzles. The pressure to the impingement nozzles is further reduced (throttled) to the desired velocity by means of a damper 46 located in the duct flow path feeding the nozzle header.

In certain embodiments, a pressure differential transmitter 40 measures the differential between the air bar pressure and the dryer enclosure pressure, measured by pressure indicator 41. The pressure transmitter 40 converts the pressure to an electronic signal, which is terminated at the PLC. A pressure indicating controller 42 located in the PLC program references the pressure input and adjusts the variable speed drive 45 automatically, to adjust the speed of fan motor 46.

In certain embodiments, dryer enclosure pressure is monitored and controlled. Pressure differential transmitter 50 measures the differential between atmospheric pressure and dryer enclosure pressure (sensed by pressure indicator 51). The pressure is converted to an electronic signal and sent to a PLC analog input where it is used in a PLC program. Pressure indicating controller 52, located in the PLC program, reference the pressure input and adjust the make-up air damper 54 actuator automatically.

In certain embodiments, pressure differential transmitter 60 measures the differential between the atmosphere pressure and the exhaust duct pressure, and converts the pressure to an electronic signal and sends the signal to a PLC analog input where it is used in a PLC program. Pressure indicating controller 61 is located in the PLC program, and references the pressure input and adjusts a variable speed drive 62 automatically. The variable speed drive 62 can be an adjustable frequency AC drive and varies the speed of a motor 63 operating exhaust fan 65. Balancing dampers 56, 57 are used to control the pressure of the top and bottom of the dryer housing.

What is claimed is:

1. A web dryer comprising an endless woven fabric loop having an upper side supporting and conveying a wet tissue web, and a plurality of spaced apart air bars that discharge air toward said wet tissue web, comprising a first set and a second set, each air bar being elongate and arranged such that its longitudinal axis is transverse to the longitudinal axis of the dryer, wherein the first set of air bars arranged above the web supported on said endless loop in the dryer comprises adjacent Coanda air bars that emit air at a velocity of 4000 to 10,000 feet per minute, and the second set of air bars arranged below the web and endless loop in the dryer comprise jet impingement air bars that emit air at a velocity of 2000 to 8000 feet per minute, and wherein each jet impingement air bar is positioned opposite two Coanda air bars of said first set and is centered between them.

2. The web dryer of claim 1, wherein the space between said jet impingement air bars comprises a removable blank.

3. The web dryer of claim 1, wherein said endless loop comprises an air-permeable belt.

4. The web dryer of claim 1, wherein the velocity of air issuing from said jet impingement air bars is 20 to 50% of the velocity of air issuing from said Coanda air bars.

5. The web dryer of claim 1, wherein all of the second set of air bars arranged below the web are jet impingement air bars.

6. The web dryer of claim 1, wherein said second set of air bars arranged below the web comprise first and second jet impingement air bars spaced a distance from each other sufficient to accommodate a third jet impingement air bar.

7. A web dryer comprising an endless woven fabric belt for supporting and conveying a wet tissue web, and an array of air bars that discharge air toward said wet tissue web, comprising a first set of adjacent Coanda air bars that are positioned above the surface of said web and endless belt that emit air at a velocity of 4000 to 10,000 feet per minute, and a second set of opposing impingement nozzles positioned below said belt that emit air at a velocity of 2000 to 8000 feet per minute, wherein each impingement nozzle is positioned opposite two Coanda air bars of said first set and is centered between them, and the air pressure in said first set of adjacent Coanda bars is balanced in relation to the air pressure in said second set of impingement nozzles to force said web to the surface of said endless belt, said second set of opposing impingement nozzles positioned to subsequently lift said web from said belt by forcing air through said belt.

8. The web dryer of claim 7, wherein the velocity of air issuing from said jet impingement air bars is 20 to 50% of the velocity of air issuing from said Coanda air bars.

9. The web dryer of claim 7, wherein all of the second set of air bars arranged below the web are jet impingement air bars.

10. The web dryer of claim 7, wherein said second set of air bars arranged below the web comprise first and second jet impingement air bars spaced a distance from each other sufficient to accommodate a third jet impingement air bar.

* * * * *